United States Patent [19]

Arnold

[11] 4,330,168

[45] May 18, 1982

[54] ELECTRICAL CONTACT AND METHOD OF MAKING SAME

[75] Inventor: Bruce K. Arnold, El Toro, Calif.

[73] Assignee: International Telephone and Telegraph Corporation, New York, N.Y.

[21] Appl. No.: 178,986

[22] Filed: Aug. 18, 1980

Related U.S. Application Data

[63] Continuation of Ser. No. 52,771, Jun. 28, 1979, abandoned.

[51] Int. Cl.[3] ..... H01R 11/08

[52] U.S. Cl. ..... 339/276 T; 408/1 R; 408/30; 29/874

[58] Field of Search ..... 339/276 R, 276 T, 276 SF; 113/119

[56] References Cited

U.S. PATENT DOCUMENTS

| | | | |
|---|---|---|---|
| 1,937,431 | 11/1933 | Mendel | 339/276 T |
| 2,794,964 | 6/1957 | Hoffman | 339/276 T |
| 2,943,293 | 6/1960 | Bucher et al. | 339/276 T |
| 3,516,048 | 6/1970 | Scheingold et al. | 339/276 T |
| 4,120,556 | 10/1978 | Waldron et al. | 339/142 |

FOREIGN PATENT DOCUMENTS

| | | |
|---|---|---|
| 1257502 | 12/1971 | United Kingdom . |
| 2002185 | 2/1979 | United Kingdom . |

*Primary Examiner*—Joseph H. McGlynn
*Attorney, Agent, or Firm*—Thomas L. Peterson

[57] ABSTRACT

A stamped contact is disclosed having an integral closed crimp barrel suitable for military/aerospace applications. In one embodiment, the crimp barrel has a rectangular cross section. A method is disclosed for making the contact in which the contact is stamped from a sheet having a relatively thick marginal edge which provides the rectangular crimp barrel for the contact. The bore in the barrel is drilled after the stamping operation.

7 Claims, 12 Drawing Figures

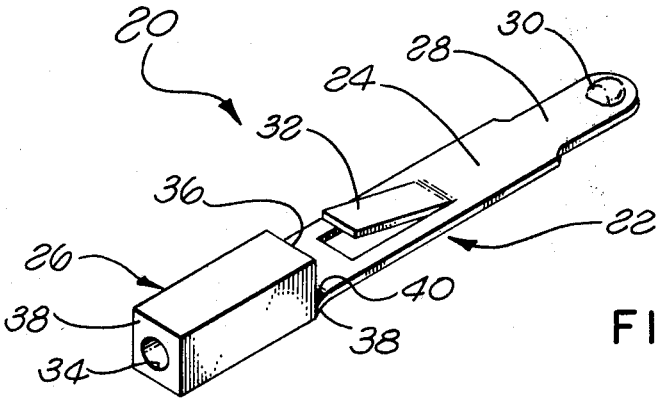
FIG. 1
FIG. 2
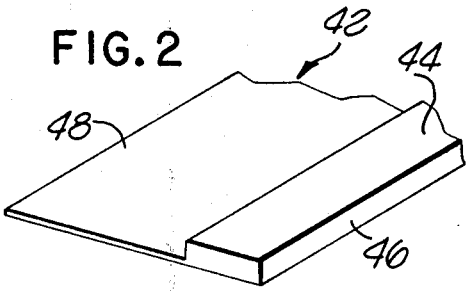
FIG. 3
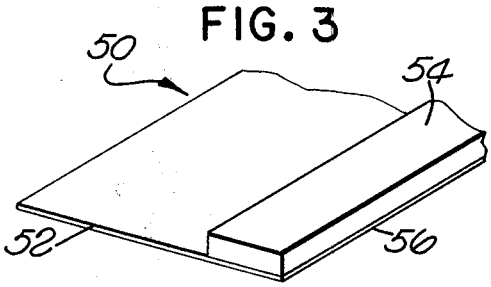
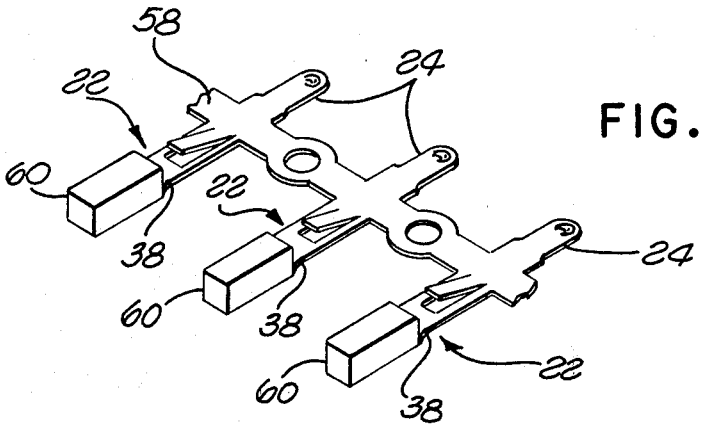
FIG. 4

ELECTRICAL CONTACT AND METHOD OF MAKING SAME

This is a continuation of application Ser. No. 052,771, filed June 28, 1979, now abandoned.

BACKGROUND OF THE INVENTION

The present invention relates generally to an electrical contact and, more specifically, to the crimp barrel of a stamped electrical contact and a method of making the same.

Stamped and formed electrical contacts—whether pin and socket, rectangular cantilever beam, or blade and tuning fork types—have traditionally used a split barrel of B crimp configuration or a split barrel oversleeved with a seamless tube for terminating the wire. The split barrel B crimp and other similar crimp configurations used for terminating stamped contacts to wires have not been considered usable for most military/aerospace applications because of their tendancy to relax under temperature cycling, vibrations and shock. As a consequence, the military has required that the split barrel be oversleeved with a seamless tube. The addition of the tube on the military-type oversleeved split barrel is objectionable for adding cost and additional wall thickness which may result in contact density penalties. Also, the tube constitutes a loose piece that can be lost.

It is the object of the present invention to overcome the attendant disadvantages of the crimp barrels of the prior art stamped and formed electrical contacts discussed above by providing a stamped contact having a closed barrel suitable for military/aerospace applications without the use of an additional tube.

SUMMARY OF THE INVENTION

According to the principal aspect of the present invention, there is provided an electrical contact comprising a stamped sheet metal contact body having a forward portion embodying a contact section and a rear termination portion. The rear termination portion of the contact comprises an integral closed crimp barrel. Thus, an additional tube is not required to close a split barrel as in the prior art stamped contacts utilized for military applications.

According to another aspect of the invention, there is provided a method for making an electrical contact in which a sheet of metal is provided having a marginal area along one edge thereof of a thickness greater than the thickness of the remainder of the sheet. A contact body is stamped from the sheet with the longitudinal axis of the body perpendicular to said edge whereby the marginal area of the sheet provides at one end of the contact body a solid barrel portion of rectangular cross-section and the remainder of the sheet provides at the other end of the contact body a substantially flat portion. An axial bore is formed in the rectangular barrel portion thus providing an integral closed crimp barrel.

BRIEF DESCRIPTION OF THE DRAWINGS

FIG. 1 is a perspective view of a preferred embodiment of the contact of the present invention;

FIG. 2 is a perspective view of an integral sheet of metal from which the contact of FIG. 1 may be formed;

FIG. 3 is a perspective view of a laminated sheet of metal from which the contact of FIG. 1 may be formed;

FIG. 4 is a perspective view of a string of contact bodies which have been stamped from the sheet of FIG. 2 in the manufacture of the contact of FIG. 1;

DESCRIPTION OF THE PREFERRED EMBODIMENTS

Figure 5:
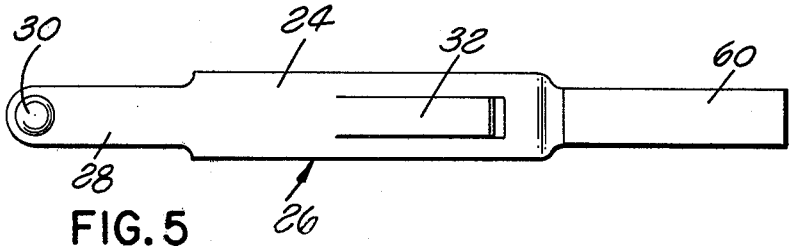
FIG. 5 is a top plan view of one of the contact bodies illustrated in FIG. 4.

Reference is now made to FIG. 1 of the drawings which shows the preferred embodiment of the contact of the present invention, generally designated 20. The contact 20 has a stamped sheet metal body 22 provided with a forward substantially flat portion 24 and a rear termination portion 26. The forward portion 24 embodies a contacting section 28 in the form of a flat blade having a dimple 30 adjacent its forwardmost end. An outwardly and rearwardly extending contact retention tine is struck out from the forward portion 24 of the contact body. The forward portion of the contact body is similar to that used in the contacts disclosed in U.S. Pat. No. 3,594,698 to John W. Anhalt. Obviously the stamped forward portion 24 of the contact may be formed into other shapes, such as a blade or tuning fork, or cylindrical pin and socket contacts, as will become more apparent as this description proceeds.

The rear termination portion 26 of the contact provides an integral closed crimp barrel having a square cross-section. Thus, the crimp barrel is seamless. The term "seamless" as used herein and in the claims is intended to mean that the crimp barrel is devoid of an open longitudinal slot, a slit, or a longitudinal joint formed, for example, by brazing or soldering. An axial bore 34 extends from the front 36 to the rear 38 of the crimp barrel. The barrel is integral with the forward portion 24 of the contact body, and is joined thereto by a bent section 38 that provides a rearwardly facing shoulder 40 in front of the barrel 26. The shoulder 40 provides a stop for limiting the depth of insertion of a wire (not shown) inserted into the bore 34 in barrel 26.

Thus, it is seen that the contact of the present invention is a stamped contact having an integral closed barrel which is not subject to relaxation as is the split barrel B crimp prior art arrangement and does not require a separate tube for surrounding a split barrel as in the conventional stamped contact crimp barrel utilized for military/aerospace applications.

The contact 20 of the present invention may be conveniently and inexpensively manufactured by stamping the contact body from an integral sheet of metal, such as the sheet 42 illustrated in FIG. 2. The sheet may be produced from contoured milled stock providing a marginal area 44 along one elongated edge 46 having a thickness equal to the cross-section of, for example, the standard military closed barrel crimp configuration, with the remaining region 48 having less thickness for forming the forward flat portion 24 of the contact. Because the sheet stock 42 is milled to provide the configuration illustrated in FIG. 2, the marginal area 44 is integral with the remainder of the sheet.

An alternative form of sheet stock which may be utilized to make the contact of the present invention is shown in FIG. 3 and is generally designated 50. Sheet 50 is a laminated structure including a relatively wide strip 52 and a narrow strip 54 lying along one edge 56 of the strip 52 and welded thereto.

Figure 6:
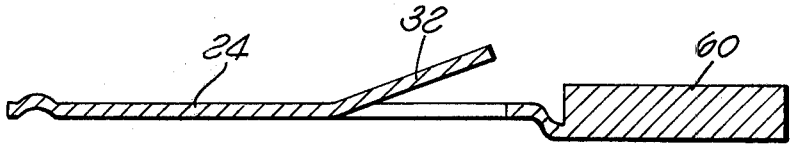
FIG. 6 is a longitudinal vertical sectional view through the contact body illustrated in FIG. 5.

FIG. 4 illustrates a plurality of contact bodies joined by a carrier strip 58 which has been stamped from the sheet of metal 42 illustrated in FIG. 2 and formed to provide the dimples 30, contact retention tines 32 and bent sections 38. The contacts are stamped from the sheet 42 with the longitudinal axis of each contact body perpendicular to the edge 46 so that the marginal area 44 provides at one end of each contact body a solid barrel portion of square cross-section, as shown in FIGS. 4 and 6, with the remainder of the sheet 48 providing the relatively flat forward portion 24 of the contact. The string of contact bodies illustrated in FIG. 4 is formed from the sheet 42 by progressive stamping and forming operations in a manner well known in the art.

Figure 7:
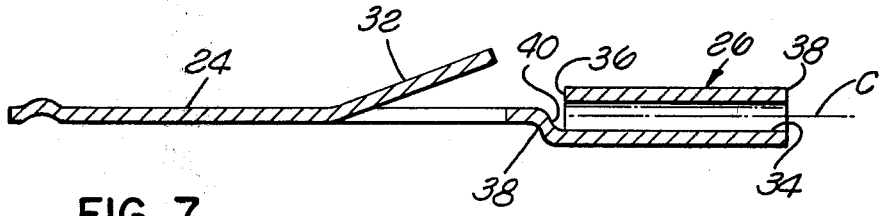
FIG. 7 is a sectional view similar to FIG. 6 showing the contact body after a bore has been drilled in the solid barrel portion of the body.

The axial bores 34 are drilled in the solid barrel portions 60 of the contact bodies either at the time that the bodies are stamped and formed on a punch press fitted with a high speed drilling attachment, or on a separate secondary drilling machine. In the embodiment of the contact illustrated in FIGS. 1 and 4–8, preferably the bore 34 is drilled prior to forming the bent portion 38 of the contact body which provides the stop 40 in front of the crimp barrel. As best seen in FIG. 7, the centerline C of the bore 34 in the crimp barrel 26 lies substantially in the plane of the flat forward portion 24 of the contact body.

Figure 9:
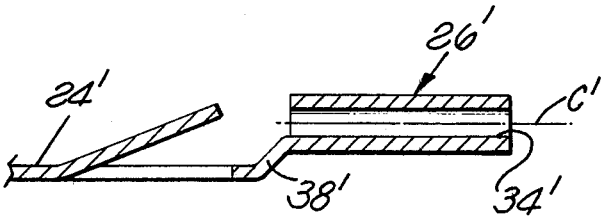
FIG. 9 is a longitudinal fragmentary sectional view showing the rear termination portion of an alternative form of the contact of the present invention.
Figure 8:
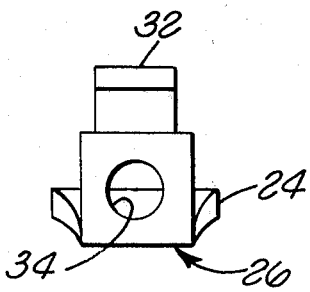
FIG. 8 is a rear end view of the contact illustrated in FIG. 7.

FIG. 9 illustrates an alternative form of the rear portion of the contact of the present invention in which the bent portion 38' of the contact body is bent upwardly so that the centerline C' of the bore 34' in the crimp barrel is offset laterally from the plane of the forward portion 24' of the contact body.

Figure 10:
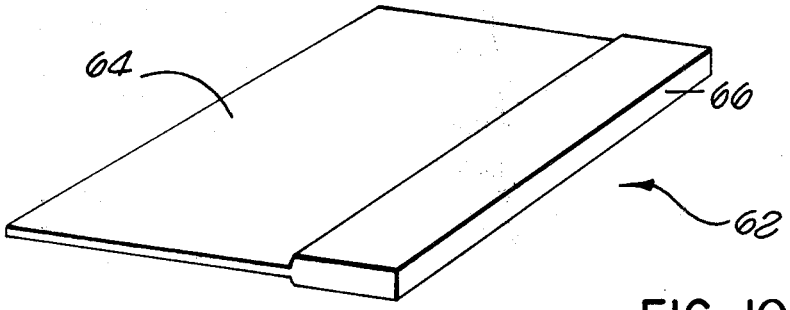
FIG. 10 is a perspective view of a further form of metal sheet from which a contact of the present invention may be formed.
Figure 11:
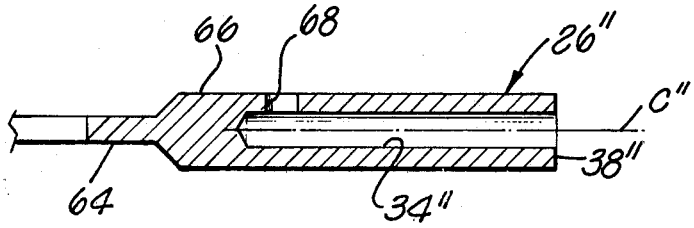
FIG. 11 is a fragmentary longitudinal sectional view through the crimp barrel portion of a contact formed from the metal sheet illustrated in FIG. 10.

FIG. 10 illustrates still a further embodiment of metal sheet, generally designated 62, from which a contact of the present invention may be formed. The sheet 62 is formed from contoured milled sheet stock, which is milled on opposite sides to provide a relatively thin region 64 with a marginal thicker region 66 adjacent to one longitudinal edge thereof so that the upper and lower surfaces of the thicker marginal area 66 are spaced above and below, respectively, the upper and lower surfaces of the thinner region 64. FIG. 11 illustrates the rear portion of a contact formed from the sheet 62 of FIG. 10. It is seen that the centerline C'' of the bore 34'' of the crimp barrel 26'' lies in the same plane as the thinner forward region 64 of the contact. In this embodiment, the bore 34'' opens only at the rear 38'' of the crimp barrel. Since the bore 34'' does not open at the front of the crimp barrel, a radial inspection and plating bleeder hole 68 is formed in the wall of the crimp barrel.

Figure 12:
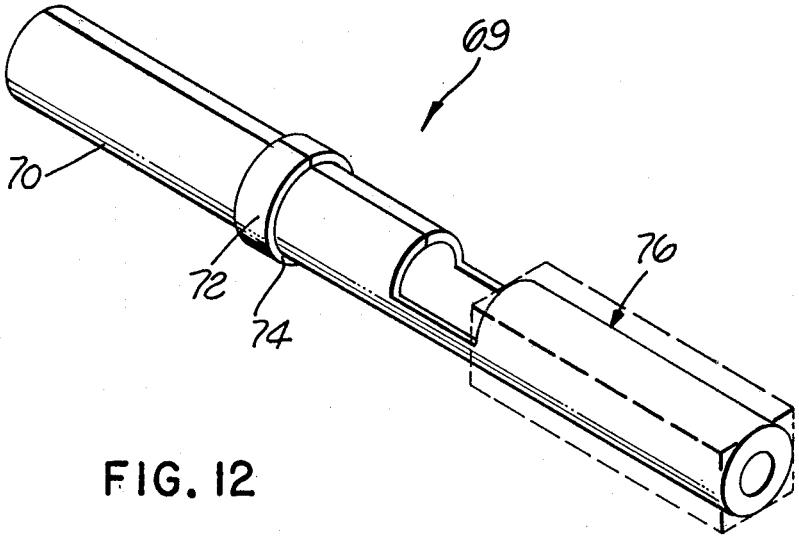
FIG. 12 is a perspective view of still a further form of the contact of the present invention in the form of a socket contact.

FIG. 12 shows a further embodiment of the contact of the present invention, generally designated 69, in which the flat forward portion of the contact body is formed into a cylinder 70 to provide a socket contact. Alternatively, the cylindrical forward portion 70 could be formed of smaller diameter with a rounded forward end to form a pin contact. Preferably the sheet of metal from which the contact 69 is formed is provided with a longitudinal ridge on its lower side so that when the forward portion of the contact is formed into a cylinder, an annular enlargement 72 is provided which forms a rearwardly facing annular shoulder 74. Such shoulder may cooperate with a contact retention tine mounted in the insulator of an electrical connector in which the contact is mounted for restricting rearward movement of the contact in the insulator. The integral closed barrel 76 of the contact 69 may have a rectangular cross-section, as shown in phantom lines, or may be coined to provide a cylindrical cross-section as shown in full lines in FIG. 12. The diameter of the cylindrical crimp barrel 76 should be no greater than the diameter of the cylindrical contact body 70 behind the shoulder 74 to allow a cylindrical contact retention tine release tool to be slipped over the rear of the contact up to the shoulder 74. The contact 69 embodying a cylindrical crimp barrel has the advantage over the rectangular cross-section crimp barrel contacts described previously herein in that a plurality of such contacts may be arranged in greater density in a connector insulator.

Crimp tensile strength tests have been conducted on No. 22 contacts having a square cross-section integral closed crimp barrel as disclosed herein. The tests were conducted in accordance with MIL-C-39029B. The contacts were terminated with MIL-W-16878/4-22 wires using a four indentor crimp tool. The specification requires that the crimp connections must withstand at least 12 pounds of tensile force. The crimp barrels were formed of either annealed lead and copper or annealed beryllium copper. Both crimp structures withstood forces averaging about 18.6 pounds, thus far exceeding the minimum requirements of the military specification. Also, it has been found that by utilizing a four indentor crimp tool on the rectangular cross-section crimp barrel of the present invention, there is less bowing longitudinally of the crimp barrel than occurs with the use of such tool on a standard cylindrical crimp barrel, apparently due to the additional material at the corners of the square barrel.

Thus, it is seen that by the present invention there is provided a stamped and formed contact with an integral closed barrel which may be readily crimped to form wire terminations suitable to meet military/aerospace requirements, is relatively inexpensively manufactured, and avoids the requirement of the use of an additional tube surrounding a split barrel to form the closed barrel configuration.

What is claimed is:

1. A method of making an electrical contact comprising the steps of:

providing a sheet of metal having a marginal area along one edge thereof of a thickness greater than the thickness of the remainder of said sheet;

stamping a contact body from said sheet with the longitudinal axis of said body perpendicular to said edge whereby said marginal area provides at one end of said contact body a solid barrel portion of rectangular cross-section and said remainder of said sheet provides at the other end of said contact body a substantially flat portion; and forming an axial bore in said solid barrel portion to form an integral closed crimp barrel.

2. A method as set forth in claim 1 wherein:

said bore is formed with its center axis substantially in the plane of said flat forward portion.

3. An electrical contact which has been made by the method of claim 1.

4. A method as set forth in claim 1 wherein:

said bore is formed with its center axis in a plane parallel to but spaced from the plane of said flat forward portion.

5. A method as set forth in claim 4 wherein:

said bore is formed to extend from the front to the rear of said barrel portion; and said flat forward portion is formed to provide a shoulder in front of said bore.

6. A method as set forth in claim 1 wherein:

said substantially flat portion is formed into a substantially cylindrical configuration.

7. A method as set forth in claim 6 wherein:

said barrel portion is formed to provide a substantially circular cross-section.

* * * * *